US006712710B2

(12) United States Patent
Pearson

(10) Patent No.: US 6,712,710 B2
(45) Date of Patent: Mar. 30, 2004

(54) MULTI-LEVEL POOL GAME APPARATUS AND METHOD

(76) Inventor: Kent Pearson, 3124 Hillside Ct., Kelseyville, CA (US) 95451

( * ) Notice: Subject to any disclaimer, the term of this patent is extended or adjusted under 35 U.S.C. 154(b) by 0 days.

(21) Appl. No.: 10/043,790

(22) Filed: Jan. 10, 2002

(65) Prior Publication Data

US 2003/0130051 A1 Jul. 10, 2003

(51) Int. Cl.[7] ..... A63D 15/04
(52) U.S. Cl. ..... 473/10
(58) Field of Search ..... 473/1, 3, 10, 12, 473/14, 20, 33, 496; 273/118 R, 119 R, 121 R, 122 R, 123 R, 124 R, 138.3, 340, 352, 353, 309, 396–398, 241, 113

(56) References Cited

U.S. PATENT DOCUMENTS 250,948 A * 12/1881 Murphy ..... 273/396
449,140 A * 3/1891 Scott et al. ..... 273/121 R
476,324 A * 6/1892 Starks ..... 273/123 R
504,347 A * 9/1893 Groves ..... 273/113
854,581 A * 5/1907 Kohler ..... 273/118 R
931,470 A * 8/1909 Patton ..... 273/123 R
1,167,655 A * 1/1916 Passig ..... 273/120 R
1,694,691 A * 12/1928 Rentz ..... 273/108.21
3,064,978 A * 11/1962 Burch ..... 273/119 R
3,550,942 A * 12/1970 Hawthorne ..... 273/119 R
3,596,911 A * 8/1971 Kessler ..... 273/123 R
5,316,307 A * 5/1994 Kersh ..... 273/241

* cited by examiner

*Primary Examiner*—Paul T. Sewell
*Assistant Examiner*—Mitra Aryanpour
(74) *Attorney, Agent, or Firm*—Birch, Stewart, Kolasch & Birch, LLP

(57) ABSTRACT

A multi-level pool game apparatus having two or more generally horizontal ball-supporting playing surfaces supported in stacked relation, spaced sufficiently apart from one another to allow player access to the lower surfaces to strike balls with a cue or the like. Each surface may have one or more ball-receiving pockets. Conduits extend between pockets at adjacent surfaces to provide pathways between such adjacent surfaces. In one form of the game, each player has a set of visually distinguishable balls, and the objective is for each player to advance his/her balls along a predetermined route from surface to surface, while impeding the advance of the other players' balls along the route. In the preferred embodiment there are three or more playing surfaces and at least one set of conduits are aligned with a pocket at an intermediate playing surface to provide both upward and downward pathways from that surface. That set of aligned conduits may include a guide that interacts with a ball entering that pocket to direct the ball either to a higher or a lower surface dependent upon the speed of the ball.

9 Claims, 8 Drawing Sheets

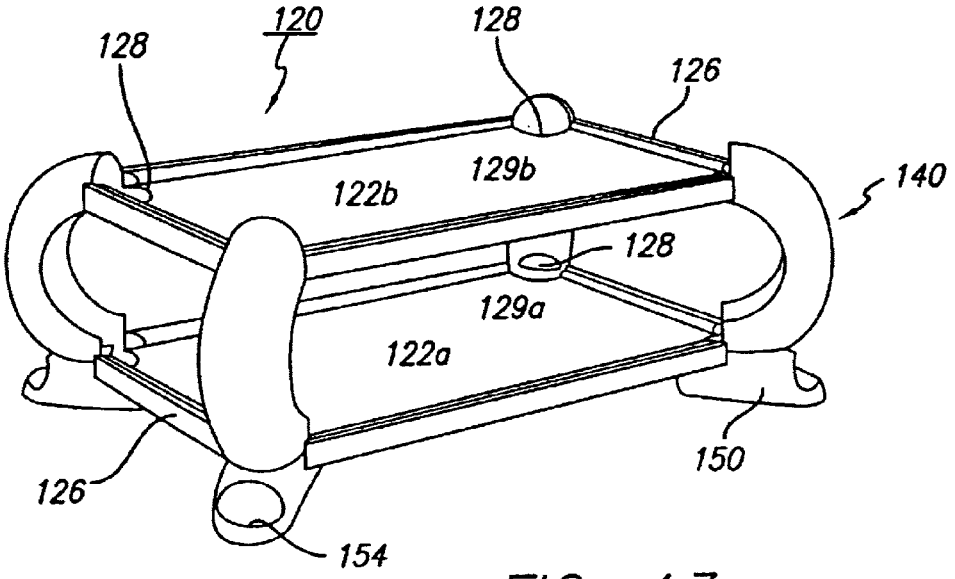
FIG. 13
FIG. 14
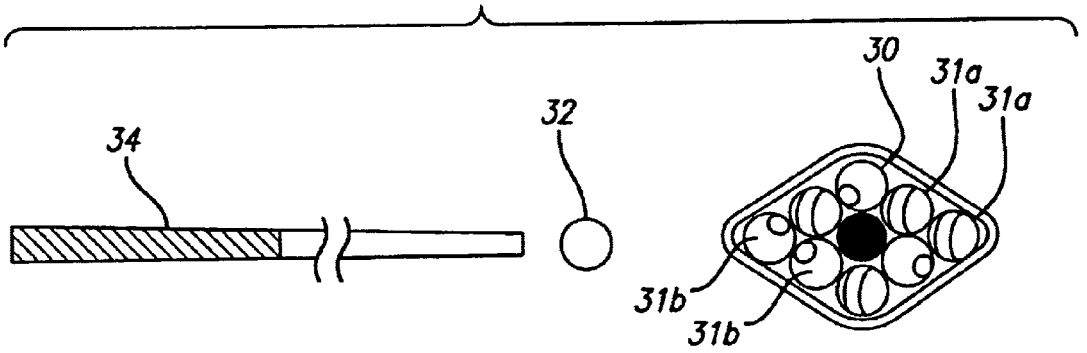

MULTI-LEVEL POOL GAME APPARATUS AND METHOD

FIELD OF THE INVENTION

The field of the invention is pool games.

BACKGROUND OF THE INVENTION

Single level pool and billiard games are a staple form of game entertainment. Applicant is not aware, however, of any prior art pool games that utilize multiple level pool tables.

Other games do exist in the prior art that operate at multiple levels. For example, we are all familiar with miniature golf courses where the ball must reverse multiple levels to reach the hole. Similarly, there are amusement park type games where balls are rolled or tossed and there are receptacles or holes at different levels, providing different scores, redirection of the balls, etc.

Applicant is also aware of multi-level games such as three-dimensional tick-tack-toe where play pieces are positioned by the players at multiple levels of the device. However in such games there is no movement of pieces from one level to another.

As noted above, applicant is not aware of any multilevel pool tables or similar structures where balls are propelled, not only over a single surface with the objective of being received in pockets at the periphery or other locations on the playing surface, but where the balls are able to travel from pockets at one surface at one level to one or more surfaces at another level for additional play at those surfaces.

SUMMARY OF THE ILLUSTRATED DISCLOSURE

The illustrated multi-level pool game apparatus 20 incorporates a presently preferred embodiment of the present invention. The pool game apparatus 20 includes a multi-level pool table 21 and a plurality of balls 30. The illustrated table 21 comprises three generally level playing surfaces 22 that are generally rectangular and have upright peripheral retaining rails or walls 26. The surfaces 22 are supported in stacked relationship with sufficient space between adjacent surfaces to provide the players with access to the intermediate and lower surfaces for striking the balls in accordance with the play of the game.

Each player may be provided with a plurality or set 31*a* of the balls 30 which are visually distinguishable from the sets of balls 31*b* of the other players. Means may be provided for striking or shooting the balls to propel them along the surfaces. In this connection striker or cue balls 32 and cue sticks 34 may be provided. Alternatively, the balls may be marble size, and one may be held and "shot" by the user as in other games of marbles.

Ball receiving pockets 28 in the form of entrance/exits are formed at each of the four corners of each of the illustrated playing surfaces 22. In the illustrated pool table 21, these pockets 28 are provided by a generally semicircular cut 29*a*, 29*b* and 29*c* in each corner of the play surface 22. The pockets 28 lead to and are in communication with conduits 40. In the illustrated apparatus, the conduits 40 extend between pockets 28 at adjacent playing surfaces 22. Thus each conduit 40 provides a pathway for the balls between adjacent playing surfaces 22.

The illustrated pool game table 21 is provided with a base in the form of four base sections 50. Each base section 50 is disposed at corner of the lowest playing surface 22*a* to support that surface and also to provide a collecting compartment 52 for the balls. Each of the illustrated compartments 52 has a retrieval opening 54 to allow balls to be recovered by the players.

The illustrated pool table 21 is provided with guide means 60 at some of the pockets 28 to direct a ball entering such a pocket either upwardly or downwardly. In the illustrated apparatus 20 this is determined by the speed of a ball: a rapidly moving ball is carried upwardly to the next higher playing surface while a slower moving ball is allowed to drop down to the next lower playing surface (or in the case of the lowest playing surface 22*a*, into a collecting compartment 52).

In one preferred form of play, each player may be provided with a group or set 31 of balls of a single color (or other distinctive visual appearance), with a cue ball 32, and with a cue stick 34 for striking the cue ball. Play starts with the balls of all players at the uppermost surface 22*c*. The players may then take turns striking their cue balls 32 with their cue sticks 34 with a dual objective: 1) to propel their own balls progressively downwardly to the intermediate surface 22*b*, then to the lowest surface 22*a*, and ultimately to the collecting compartments 52, and/or 2) to propel their opponents' balls to higher surfaces so as to negate their opponents' efforts to have their balls reach the collecting compartments.

IN THE DRAWINGS

FIG. 1A is a schematic top plan view of the apparatus of FIG. 1.

FIG. 13 is a schematic perspective view of an alternative simplified embodiment of the invention.

FIG. 14 is a schematic plan view of a cue stick, a cue ball and two different sets of player balls.

DETAILED DESCRIPTION OF THE DRAWINGS

Figure 1:
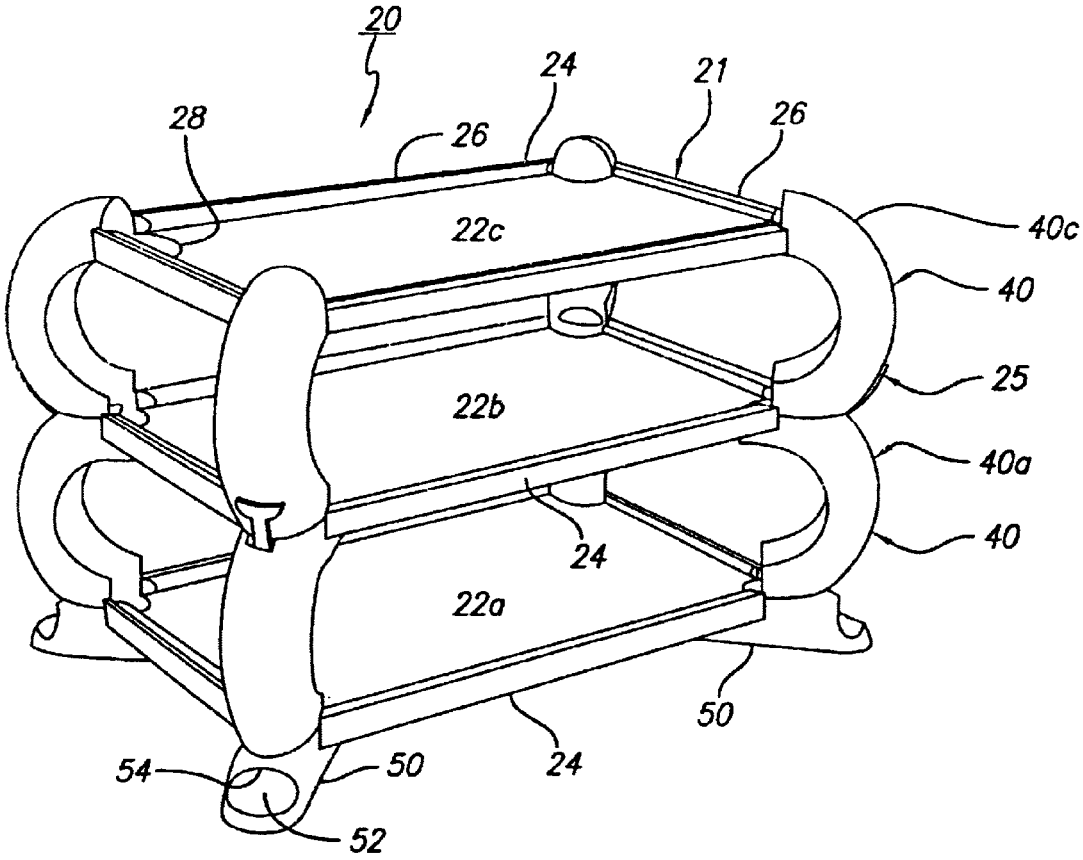
FIG. 1 is a schematic perspective view of a multi-level pool game apparatus which incorporates a presently preferred embodiment of the invention.

The illustrated multi-level pool game apparatus 20 is shown in FIG. 1. The illustrated apparatus 20 includes the multi-level table 21 and a plurality of balls 30. The illustrated table 21 has three stacked and spaced about playing surfaces 22. Each of the illustrated playing surfaces 22 is generally rectangular and is provided by a generally rectangular plate section 24 that has an upstanding peripheral retaining rail 26 to retain the balls on the associated playing surface 22. Each of the playing surfaces 22 is generally flat or level. The plate sections 24 may be formed of any suitable material such as molded plastic. At each corner of each surface 22, there is a ball-receiving pocket 28 provided by generally semicircular cutout portion 29.

Figure 12:
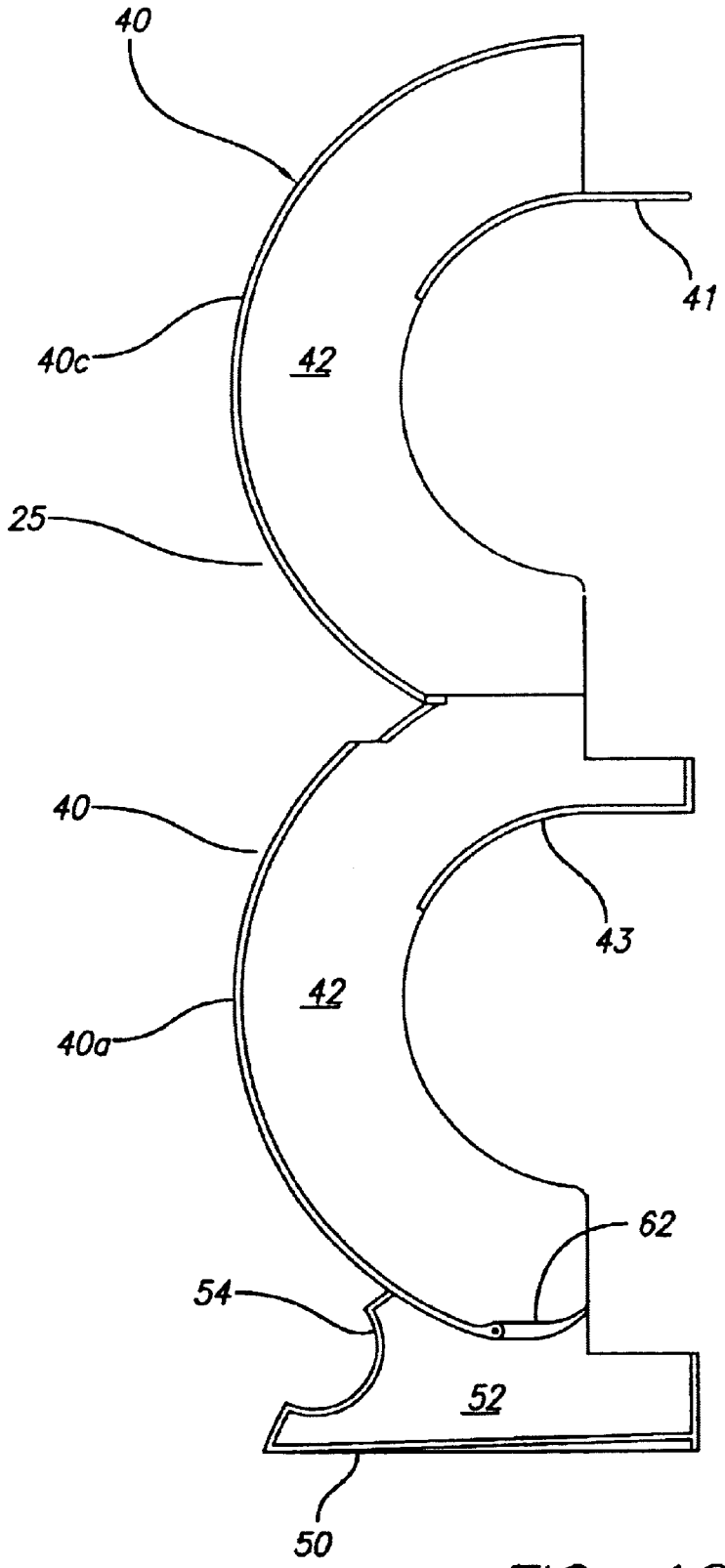
FIG. 12 is an enlarged schematic side sectional view of a corner support member of the apparatus.

The illustrated plate/sections 24 are supported in stacked spaced apart relation as shown in FIG. 1 by four upright corner support sections 25, one of which is illustrated in FIG. 12. The support sections 25 may also be fabricated from a suitable material such as molded plastic. Each illustrated support section 25 provides an upper conduit 40*c*, a low conduit 40*a* and a base section 50. Each illustrated conduit 40 is a generally tubular C-shaped portion that is cut away to some extent at its interior side. This cutaway saves on cost and material and provides visibility whereby the user can see the balls as they pass along the passageways defined by the conduits.

Figure 7:
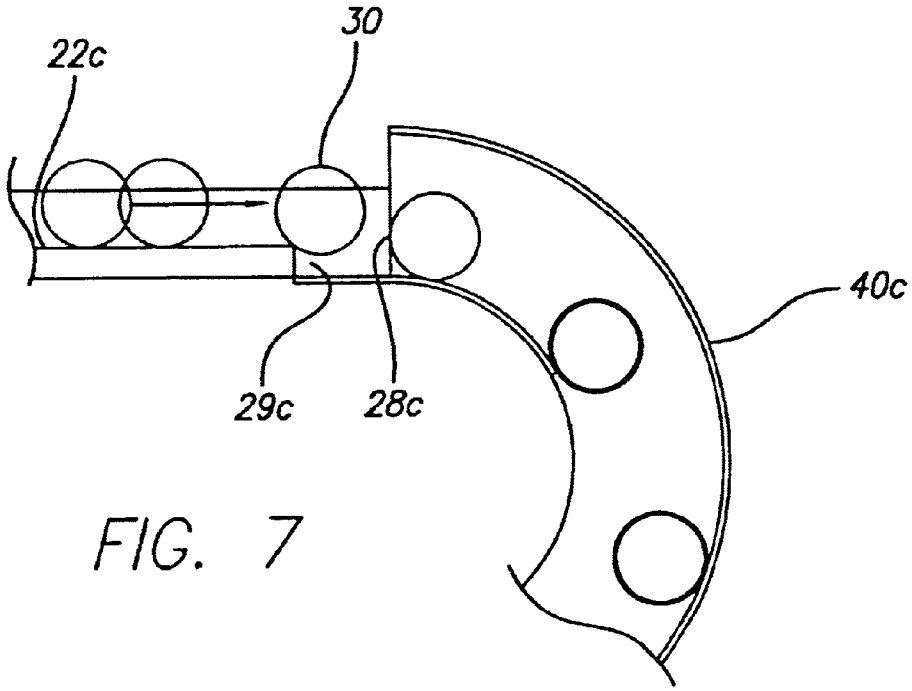
FIG. 7 is an enlarged schematic side sectional view of the apparatus showing a ball leaving the top playing surface and entering the upper end of an upper conduit leading to the intermediate playing surface.

The uppermost of the play surfaces 22*c* has its four pockets 28*c* each in communication with the upper end of an upper conduit 40*c* of one of the upright support sections 25. Each support section 25 has a small inwardly extending upper portion 41 which provides a floor for its associated upper cutout portion 29*c*. This ensures that the balls will proceed from the upper end of an upper conduit 40*c* through an associated upper pocket 28*c* and onto the upper surface 22*c* as illustrated at the upper left of FIG. 3 and in FIG. 4. Similarly, balls from the upper surface 22*c* will proceed through an upper pocket 28*c* and into the upper end of an associated upper conduit 40*c* as illustrated at the upper right of FIG. 2 and FIG. 7.

Figure 8:
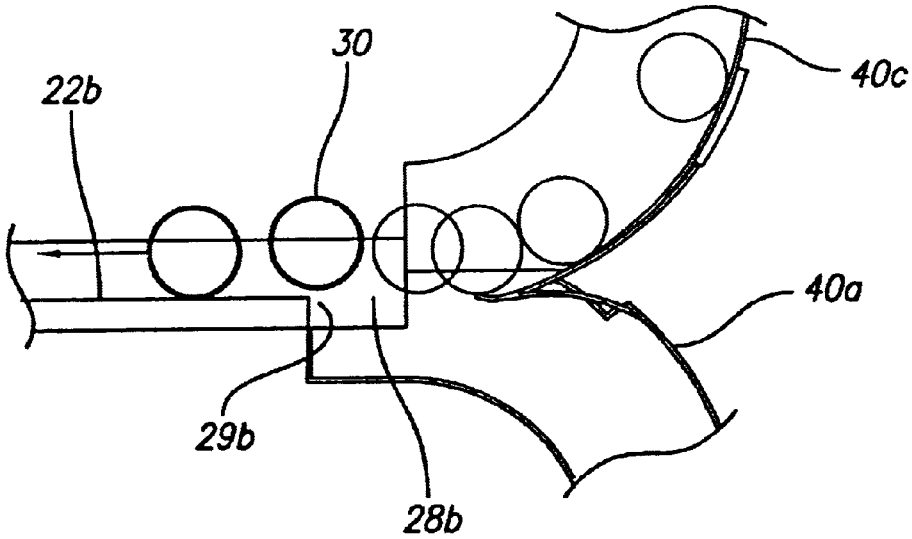
FIG. 8 is an enlarged schematic side sectional view of the apparatus illustrating a ball leaving the lower end of an upper conduit and progressing onto the intermediate playing surface.

Now attention is directed to the intermediate surface 22*b*. This surface 22*b* has four corner cutouts 29*b* providing pockets 28*b* at each corner. These pockets 28*b* are each in communication with the lower end of an associated upper conduit 40*c* and with the upper end of an associated lower conduit 40*a*. As shown at the middle left of FIG. 2 and in FIG. 8, a ball proceeding down an upper conduit 40*c* will have sufficient momentum from the fall to move across the associated cutout 29*b* onto the intermediate surface 22*b*.

Figure 2:
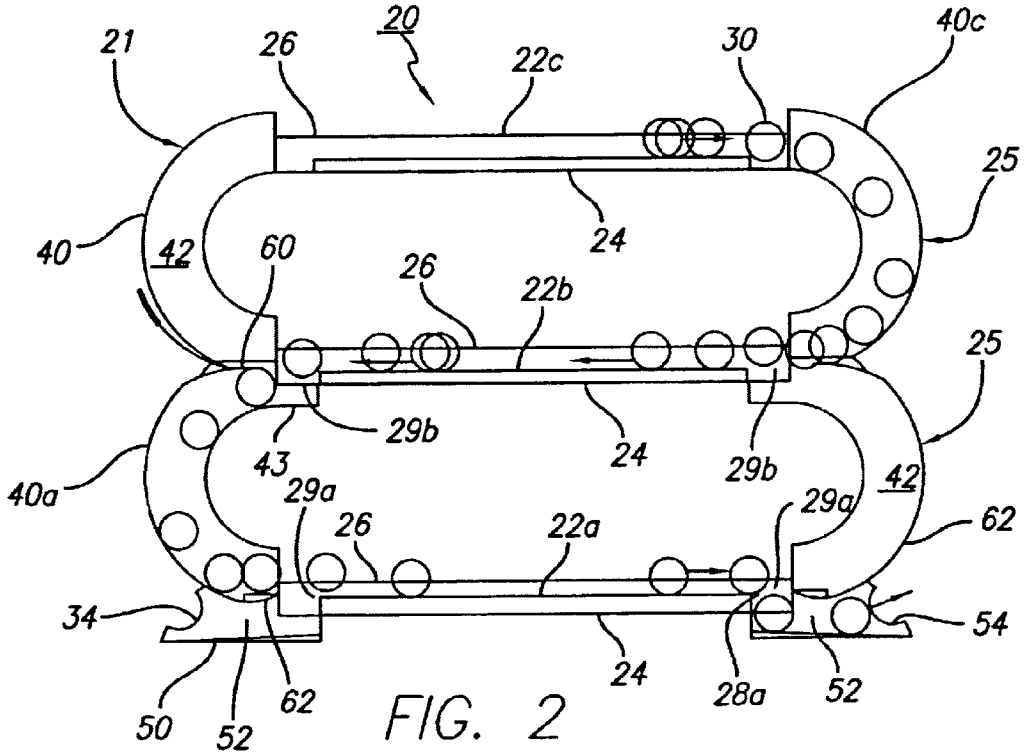
FIG. 2 is a schematic side sectional view of the apparatus taken along a diagonal plane such as 2—2 of FIG. 1A, illustrating the progressive movement of a ball from the lower level to the intermediate level, then to the bottom level and then to a collection compartment.
Figure 3:
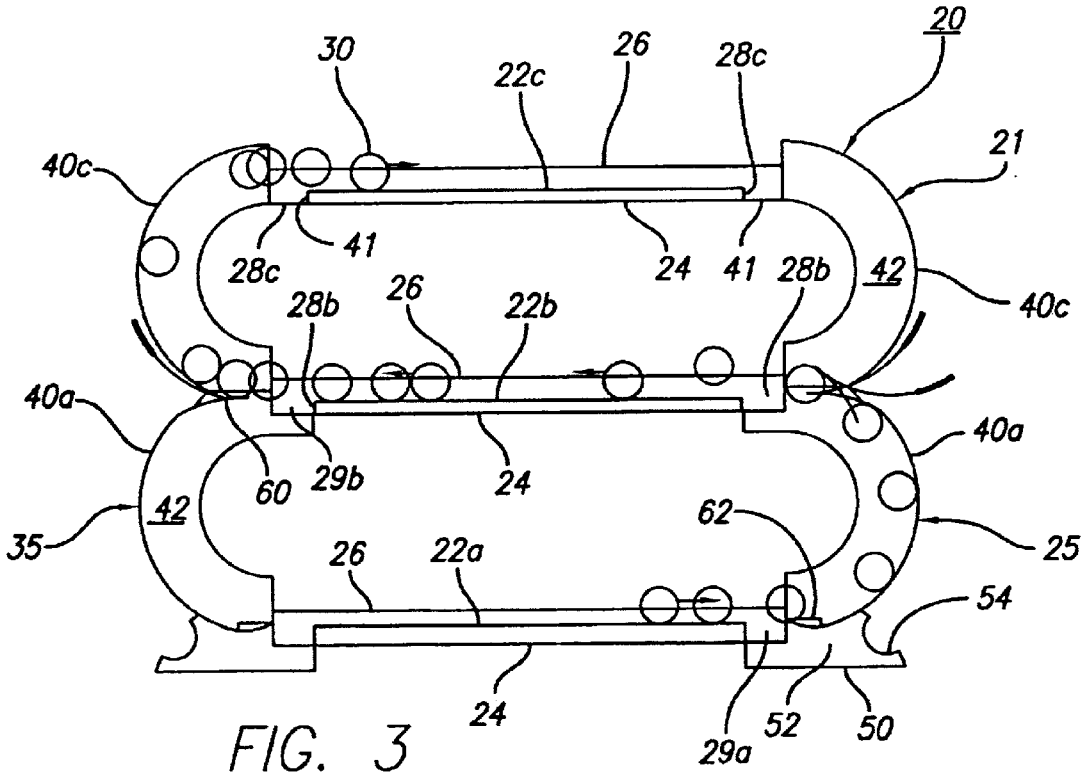
FIG. 3 is a schematic side sectional view of the apparatus like FIG. 2, illustrating the progressive movement of a ball from the bottom level to the intermediate level and then to the top level.
Figure 4:
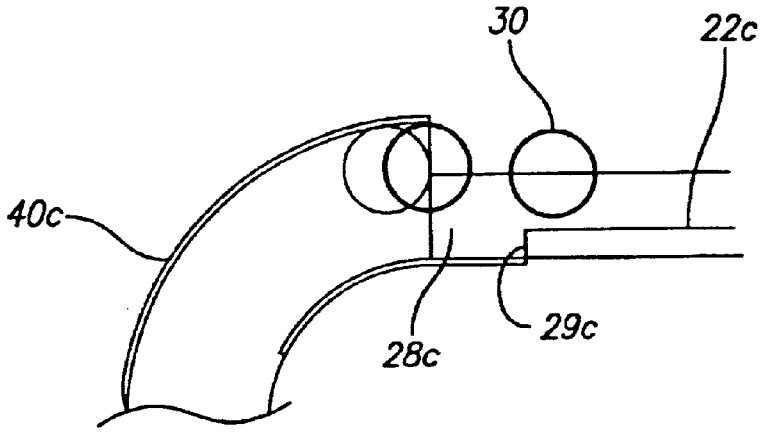
FIG. 4 is an enlarged schematic side sectional view of a portion of the apparatus showing of a ball emerging from the upper end of an upper conduit onto the top playing surface.
Figure 6:
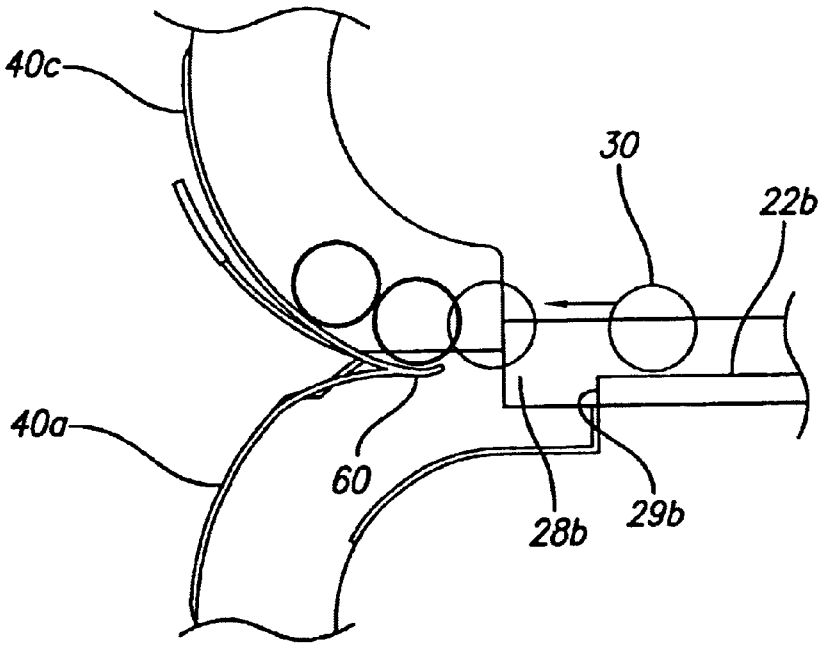
FIG. 6 is an enlarged schematic side sectional view of the apparatus showing a ball leaving the intermediate playing surface with sufficient speed to enter the lower end of an upper conduit leading to the upper playing surface.
Figure 9:
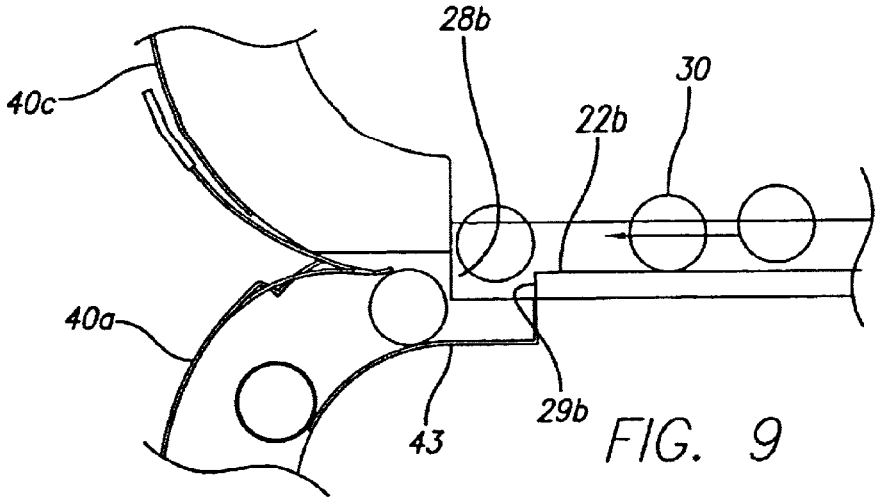
FIG. 9 is an enlarged side sectional view of the apparatus showing a ball leaving the intermediate playing surface with sufficiently slow speed to drop down and enter the upper end of a lower conduit to a lower playing surface.

A ball directed from the intermediate surface 22*b* to a pocket 28*b* may proceed either upwardly or downwardly. In this regard, FIGS. 3 and 6 show such a ball proceeding upwardly, while FIGS. 2 and 9 show such a ball proceeding downwardly. The construction of the illustrated apparatus 20 facilitates this alternative flow, which depends upon the speed at which the ball is moving when it enters a pocket 28*b*. More particularly, a middle guide 60 is provided at the juncture between each pair of aligned upper and lower conduits 40*c*, 40*a*. These middle guides 60 extend generally horizontally inwardly toward their associated cutouts 29*b* and are generally horizontally aligned with the intermediate playing surface 22*b*. Thus when a ball is propelled sufficient speed along surface 22*b* and into a pocket 28*b*, it will span the associated gap 29*b* and reach the associated guide 60. This is illustrated to the center left of FIG. 3 and in FIG. 6. The ball may then progress upwardly through the upper conduit 40*c* and ultimately onto the upper playing surface 22*c*.

The upper ends of the lower conduits 40*a* are positioned sufficiently below the level of the intermediate playing surface 22*b* and the level of the associated middle guide 60 to allow a ball from surface 22*b* to enter the upper end of a conduit 40*a*. As shown in FIGS. 12, 2 and 9, the inside or inward surfaces of the upper ends of the lower conduits 40*a* form arcuate collector surfaces 43 for catching a slow moving ball that falls through an associated cutout 29*b* and guiding that ball into the upper end of the associated lower conduit 40*a*. The ball may then progress downwardly through that lower conduit 40*a* to the lower playing surface 22*a*.

Figure 10:
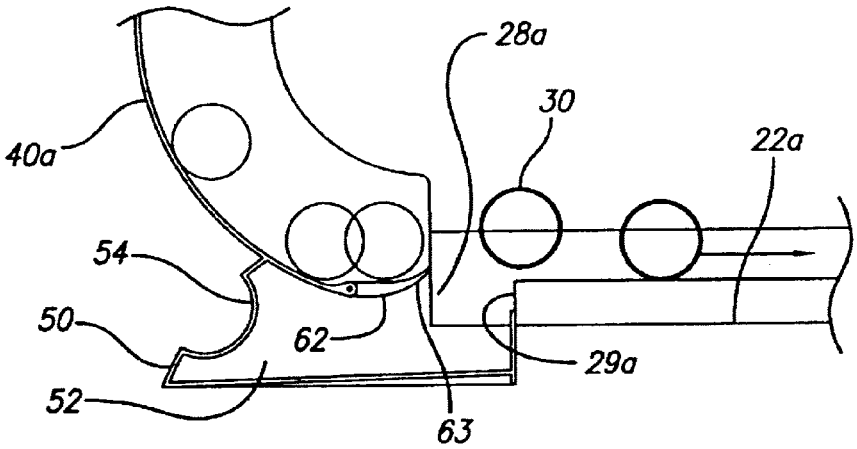
FIG. 10 is an enlarged schematic side sectional view of the apparatus illustrating a ball leaving the lower end of a lower conduit and progressing onto the bottom playing surface.

The lower end of each lower conduit 40*a* is provided with an inwardly extending lower guide 62 that is generally an extension of the lower end of that lower conduit. The lower guide 62 extends generally horizontally and generally at the height of the lower playing surface 22*a*. The lower guide 62 has a slightly raised lip 63 at its end that causes a ball rolling down the associated lower conduit 40*a* and over the lip 63 to have its path of movement directed somewhat upwardly. Thus, as shown at the lower left of FIG. 2 and in FIG. 10, a ball coming down a lower conduit 40*a* is thereby assisted to bridge the gap 29*a* and pass onto the lower surface 22*a*.

Figure 11:
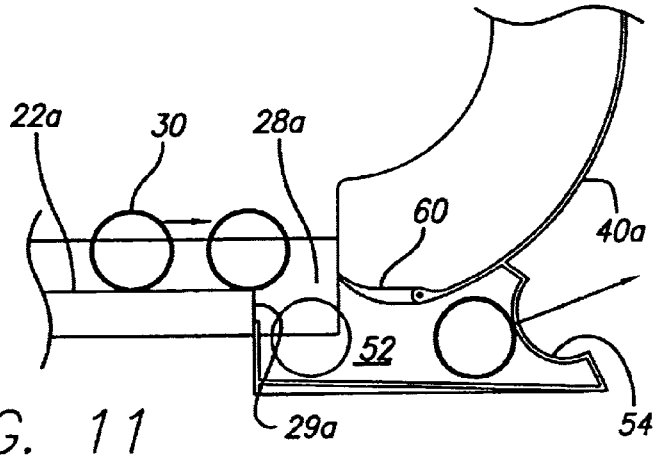
FIG. 11 is an enlarged schematic side sectional view of the apparatus illustrating a ball leaving the bottom playing surface with sufficiently slow speed to drop down and enter one of the collecting compartments.

As shown at the lower right of FIG. 2 and in FIG. 11, the base sections 50 extend sufficiently below the lower play surface 22*a* and thus below the lower guides 62, and the gaps 29*a* are sufficiently large, to allow a ball moving sufficiently slowly from the lower surface 22*a* through a pocket 28*a* to drop down through the associated gap 29*a* and into a compartment 52. Balls may be retrieved from the compartments 52 through the associated retrieval openings 54. The bottoms of the illustrated compartments 52 are inclined slightly to cause balls to roll to the areas adjacent to the openings 54.

As shown at the lower right of FIG. 3, when a ball is moving sufficiently rapidly along lower surface 22*a*, it will bridge the gap 29*a* and travel upwardly through the associated lower conduit 40*a*.

Figure 5A:
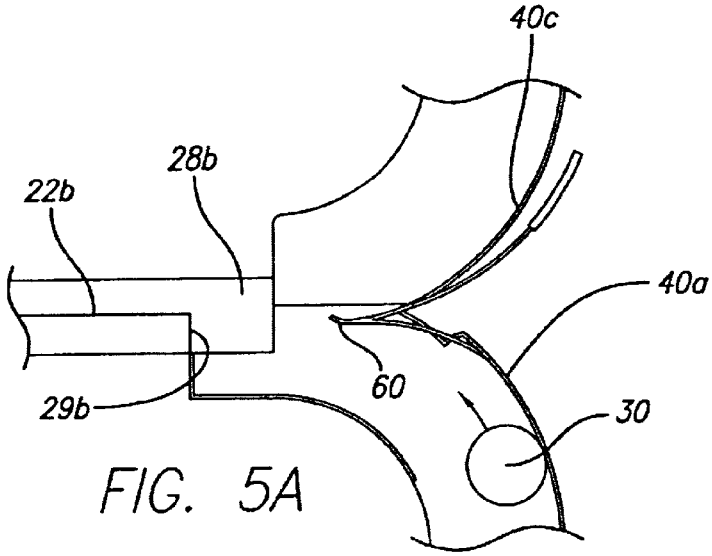
FIGS. 5A, 5B and 5C are enlarged schematic side sectional views of the apparatus illustrating a ball moving from the upper end of a lower conduit onto the intermediate playing surface.
Figure 5B:
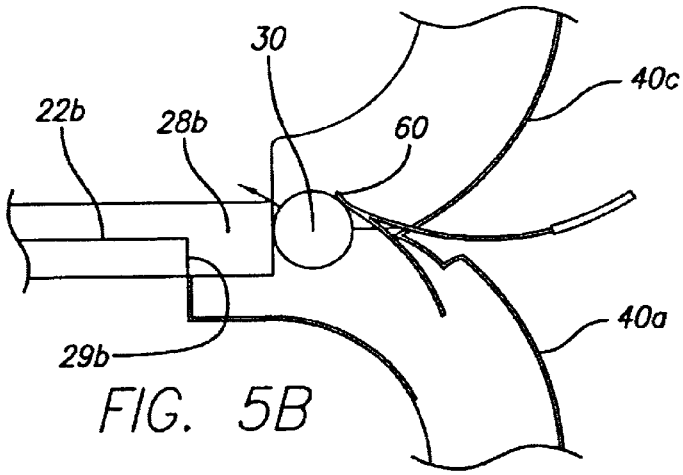
Figure 5C:
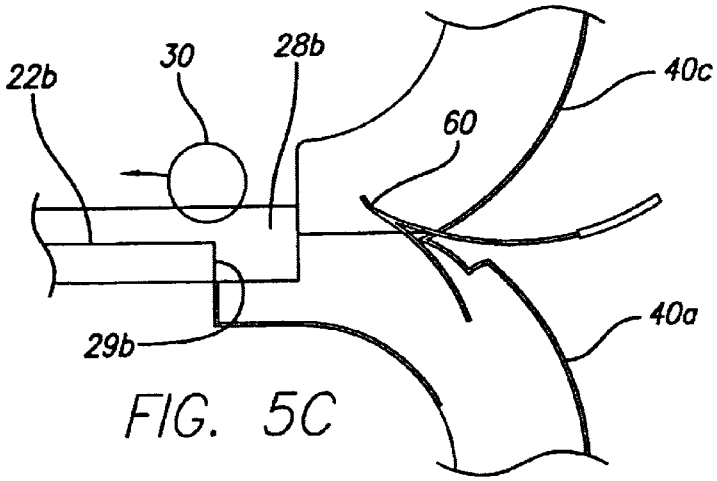

FIGS. 5A through 5C illustrate a ball 30 moving up to the intermediate surface 22*b*.

In FIG. 5A, the ball 30 is moving up a lower conduit 40*a*. In FIG. 5B the ball has engaged and pushed aside the associated guide 60. In FIG. 5C, the ball has continued past the associated pocket 28*b* and gap 29*b*, and moved onto the intermediate surface 22*b*.

In the play of the game, the players may take turns causing balls to move across the surfaces 22 and into pockets 28 in accordance with rules of the particular game being played. In one presently preferred form of the game, each player may be provided with a plurality or set 31 of balls 30 which are distinctively visually marked so it is different as to different them from the balls of the other player or players. One or more cue or striker balls 32 may be provided and the players may be provided with a striker means such as a cue stick 34. The objective of each player is to move all of his or her balls from the upper surface 22*c* to the compartments 52 before the other players are able to do the same with their balls. To accomplish this, each player would attempt to get his or her balls to travel for the upper surface 22*c* through a pocket 28*c* and an associated upper conduit 40*c* to the intermediate surface 22*b*, then through a pocket 28*b* and down an associated lower conduit 40*a* to the lower surface 22*a*. Finally, he or she would want to propel their balls through a pocket 28*a* and into a compartment 52. Such pattern of play would be challenging and interesting in and of itself.

The illustrated apparatus 20 however permits a more varied and complex pattern of play. As noted above, a ball entering an intermediate pocket 28*b* may travel either upwardly or downwardly. Similarly, a ball from the lower surface 22*a* entering a lower pocket 28*a* may travel upwardly to a higher surface 22*b* or downwardly into one of the compartments 52. Thus it would be possible for a player who was attempting to have one of his or her balls move downwardly, instead inadvertently travel upwardly to a higher level if that ball had sufficient speed when it entered a pocket 28. This would probably not happen very often if it were only a question of a player striking his or her ball too hard to give it too much speed. However, to make the game more interesting and exciting, each player may be allowed to propel the balls of his or her opponent into pockets 28 and may thereby intentionally propel an opponent's balls to a higher level to thereby impede their progress toward the lower compartments 52. This also gives the players more choices as to their strategy in that they can work on propelling their balls downwardly toward the compartments 52 or their opponents' balls upwardly to a higher level surface.

Obviously, there are many alternate ways that the scoring can be accomplished other than the first player to have all his or her balls reaching the pockets being the winner. For example, players may get points whenever one of their balls moves from a higher to a lower level surface, and may lose points when one of their balls progresses in the opposite direction from a lower to a higher level surface. Players may be given more points for their own progress as distinguished from impeding an opponent's progress or, vice versa, may be given more points for impeding an opponent's progress than for their own progress. The winner might be the player having the most points after a predetermined time interval.

Whatever the details of scoring utilized in play of the game, it will be appreciated that the structure of the illustrated apparatus 20 which allows the selective direction of a ball to an upper or lower location adds greatly to the play value and the variety and interest of this game. It also adds a dimension of skill in that the players are not only trying to cause balls to enter to a pocket but also must take into account the speed at which a ball enters the pocket, as such will determine whether the ball goes upwardly or downwardly.

FIG. 13 illustrates a simplified alternative preferred embodiment 120 having two levels 122*a*, 122*b* instead of three levels. Ball at the lower level 122*a* can be propelled upwardly to the upper level 122*b*, and balls at the upper level 122*b* can be propelled downwardly to the lower level 122*a*.

What is claimed is:

1. A multi-level pool table game for playing with plurality of balls, said pool table game comprising:

1) at least three generally level playing surfaces each having peripheral raised boundaries and a plurality of ball-receiving pockets, 2) support structure for supporting said playing surfaces in generally stacked relation to one another with sufficient space between adjacent surfaces to afford players access to the lower of such adjacent surfaces to impart rolling motion to one or more of the balls, 3) conduits connected to and providing pathways extending between pockets of adjacent pairs of the surfaces, at least one bi-directional pocket at an intermediate surface connected to and in communication with a conduit and pathway leading to a higher level surface and to with a conduit and a pathway leading to a lower level surface, and guide means at said bi-directional pocket for selectively directing balls entering that bi-directional pocket from the associated playing surface either into the conduit and pathway leading upwardly or the conduit and pathway leading downwardly.

2. The pool table game of claim 1 wherein each playing surface has a plurality of said pockets, each of said pockets being generally vertically aligned with at least one other pocket at another adjacent playing surface, there being one of said conduits connected to and extending between each of said pairs of aligned pockets.

3. A method of playing a multi-level pool game comprising the steps of:

1. providing a plurality of generally level stacked, spaced apart playing surfaces including a top surface, a bottom surface and at least one intermediate surface disposed between the top and bottom surfaces, the intermediate surface having at least one bi-directional pocket in communication via conduits to both a higher surface and a lower surface, 2. providing a plurality of balls and means for players to cause selected balls to roll along the surfaces, 3. providing guide means at the bi-directional pocket for directing a ball entering that pocket either upwardly to a higher surface or downwardly to a lower surface, dependent upon the speed of the ball, and 4. having the players take turns directing one of the balls into such a bi-directional pocket at a speed selected by the player to cause the ball to be directed either upwardly or downwardly in furtherance of that player's game objective.

4. A multi-level pool game apparatus for play with a plurality of balls, comprising:

1) three or more generally level playing surfaces each have raised boundaries and at least one bal-receiving pocket, 2) support structure holding said surfaces in generally stacked relation to one another with sufficient space between adjacent surfaces to afford players access to each of said surfaces, 1) at least one conduit connected to and extending between pockets of each adjacent pair of said surfaces to provide a pathway for travel of a ball between each paid of said surfaces, there being at least one bi-directional pocket of at least one of said surfaces which is located intermediate a higher and a lower one of said surfaces and is connected to and in communication with both an upwardly extending conduit and a downwardly extending conduit, said apparatus also comprising guide means at each of said bi-directional pockets for interacting with the associated conduits and a ball entering a bi-directional pocket from the associated intermediate playing surface to direct that ball either upwardly or downwardly, depending upon the speed of the ball.

5. The pool game apparatus of claim 4 wherein each playing surface has a plurality of said pockets, each of said pockets being generally vertically aligned with at least one other pocket at another adjacent playing surface, there being one of said conduits connected to and extending between each of said pairs of aligned pockets.

6. A multi-level pool game apparatus for play with at least one ball, comprising:

1) at least two generally level playing surfaces for supporting a ball for rolling movement over each of said surfaces, each of said surfaces have raised boundaries and at least one ball-receiving pocket, 2) support structure holding said surfaces in generally stacked relation to one another, with sufficient space between said surfaces to afford players access to each of said surfaces so as to propel a ball along each of said surfaces and into a selected pocket of the surface, 3) at least one conduit connected to and extending between pockets of adjacent of said surfaces to provide a generally continuous pathway for travel of a propelled ball from a lower surface to an adjacent upper surface or from an upper surface to a lower adjacent surface.

7. The apparatus of claim 6 wherein each of said playing surfaces has a plurality of said ball-receiving pockets, there being a plurality of said conduits.

8. The apparatus of claim 7 wherein said pockets of each playing surface are paired off and generally vertically aligned with a pocket of at least one adjacent playing surface, there being one of said conduits connected to and extending between each of said pairs of aligned pockets.

9. The game apparatus of claim 6 further including a plurality of balls.

* * * * *